US008966780B2

(12) United States Patent
Lin

(10) Patent No.: US 8,966,780 B2
(45) Date of Patent: Mar. 3, 2015

(54) TUMBLE DRYER

(76) Inventor: Hui-Li Lin, Tainan (TW)

( * ) Notice: Subject to any disclaimer, the term of this patent is extended or adjusted under 35 U.S.C. 154(b) by 429 days.

(21) Appl. No.: 12/857,078

(22) Filed: Aug. 16, 2010

(65) Prior Publication Data

US 2012/0036729 A1 Feb. 16, 2012

(51) Int. Cl.

| | |
|---|---|
| ***D06F 58/22*** | (2006.01) |
| ***D06F 58/28*** | (2006.01) |
| ***D06F 58/02*** | (2006.01) |
| ***D06F 58/20*** | (2006.01) |

(52) U.S. Cl.

CPC ..... *D06F 58/02* (2013.01); *D06F 58/20* (2013.01); *D06F 58/28* (2013.01); *D06F 2058/2854* (2013.01)

USPC ..... 34/82; 34/605; 34/606; 34/140; 34/235

(58) Field of Classification Search

CPC ..... D06F 58/10; D06F 58/28

USPC ..... 34/72, 82, 132, 596, 605, 606, 607, 34/140, 235

See application file for complete search history.

(56) References Cited

U.S. PATENT DOCUMENTS

| | | | | |
|---|---|---|---|---|
| 2,574,298 | A * | 11/1951 | Smith | 34/530 |
| 2,824,386 | A * | 2/1958 | Stone | 34/75 |
| 4,286,391 | A * | 9/1981 | Gerry | 34/543 |
| 4,875,298 | A * | 10/1989 | Wright | 34/86 |
| 6,678,969 | B1 * | 1/2004 | Hong | 34/595 |
| 2004/0143987 | A1 * | 7/2004 | Phillips | 34/218 |

* cited by examiner

*Primary Examiner* — Jiping Lu

(74) *Attorney, Agent, or Firm* — Muncy, Geissler, Olds & Lowe, P.C.

(57) ABSTRACT

A tumble dryer includes a housing, which has an enclosable drying chamber, a heater mounted in the enclosable drying chamber, a gate for closing/opening the enclosable drying chamber and a tumbler rotatably mounted in the drying chamber, an intake pipeline equipped with an intake control valve for guiding outside air into the drying chamber, an exhaust pipeline equipped with an exhaust control valve for guiding air out of the drying chamber to the atmosphere, an air-suction pipeline equipped with a pipeline control valve and having a pump installed therein for pumping air out of the drying chamber to the atmosphere.

11 Claims, 2 Drawing Sheets

TUMBLE DRYER

BACKGROUND OF THE INVENTION

1. Field of the Invention

The present invention relates to drying machines and more particularly, to a high-efficiency tumble dryer that draws moisture away from washing rapidly.

2. Description of the Related Art

A regular tumble dryer generally comprises a tumbler for turning washing over and over, means to blow warm air onto washing, and vent system to carry air moisture away from the machine. In order to improve the drying efficiency, two methods may be selected. One method is the use of a thermostat to avoid overhead. The other method is the use of a moisture sensor to avoid continuous working after washing having been dried. These two methods are not good methods to effectively improve the drying efficiency. They cannot reduce energy consumption significantly. Due to the principle of using fresh (dry) air to replace old (wet) air in the tumble dryer, conventional tumble dryers cannot draw air moisture away from the machine effectively.

Therefore, it is desirable to provide a tumble dryer, which eliminates the drawbacks of conventional designs.

SUMMARY OF THE INVENTION

The present invention has been accomplished under the circumstances in view. It is the main object of the present invention to provide a tumble dryer, which draws air moisture rapidly away from the machine so that the low-pressure dry environment left thereafter provides very dry air to facilitate quick evaporation of the water molecules in washing, allowing evaluation of the dry rate of washing subject to the evaporation speed of the water molecules.

To achieve this and other objects of the present invention, a tumble dryer comprises a housing, an intake pipeline, an exhaust pipeline and an air-suction pipeline. The housing comprises an enclosable drying chamber, a heater mounted in the enclosable drying chamber, a gate disposed at one side of the enclosable drying chamber for access control and a tumbler rotatably mounted in the drying chamber for turning washing over and over. The intake pipeline extends from the outside of the housing to the drying chamber for guiding outside air into the drying chamber, comprising an intake control valve controllable to open/close the intake pipeline. The exhaust pipeline extends from the drying chamber to the outside of the housing for guiding air out of the drying chamber to the atmosphere, comprising an exhaust control valve controllable to open/close the exhaust pipeline. The air-suction pipeline is disposed in communication between the drying chamber and the space outside the drying chamber, comprising a pipeline control valve controllable to open/close the air-suction pipeline and a pump controllable to pump air out of the drying chamber to the atmosphere.

DETAILED DESCRIPTION OF THE INVENTION

Figure 1:
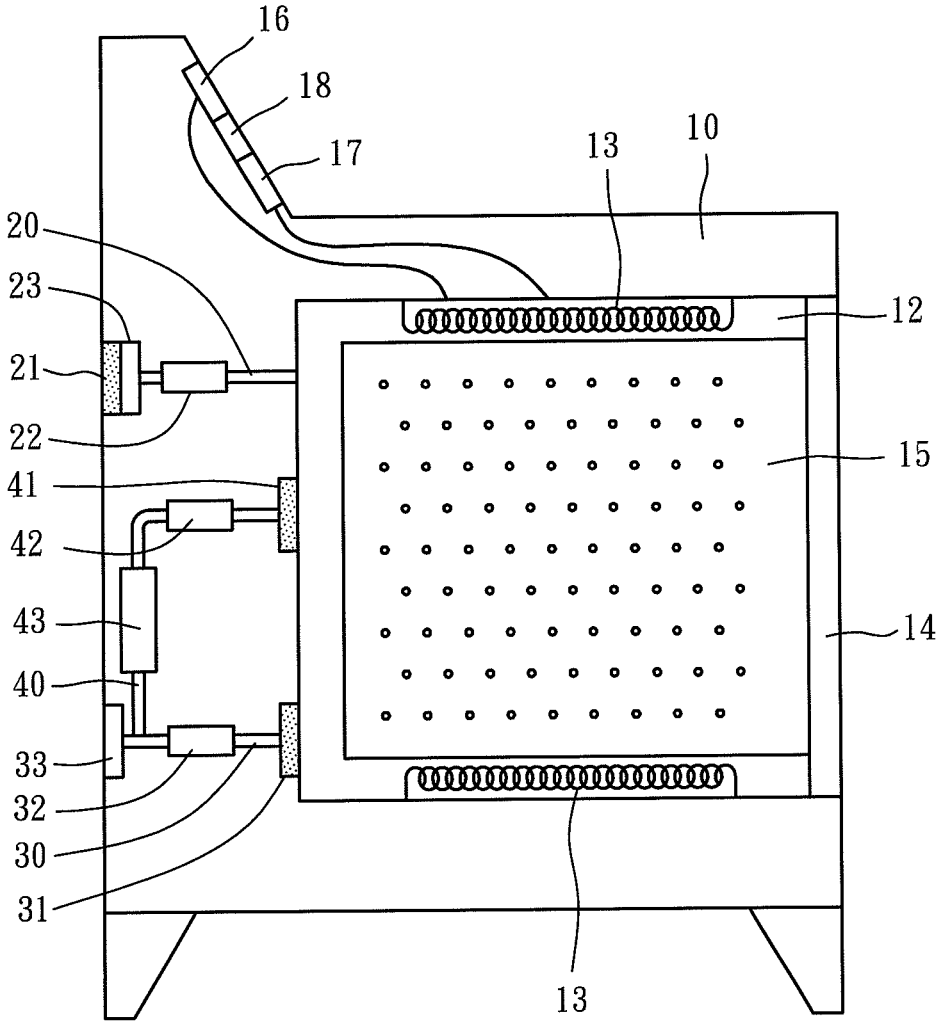
FIG. 1 is a schematic sectional side view of a tumble dryer in accordance with a first embodiment of the present invention.

Referring to FIG. 1, a tumble dryer in accordance with a first embodiment of the present invention is shown comprising a housing 10, an intake pipeline 20, an exhaust pipeline 30 and an air-suction pipeline 40.

The housing 10 comprises a drying chamber 12 that can be closed, a heater 13 mounted in the drying chamber 12 and adapted for heating the air in the drying chamber 12, a gate 14 arranged at one side of the drying chamber 12 and openable for enabling the during chamber to be in communication with the outside space, and a tumbler 15 rotatably mounted in the drying chamber 12 for holding things to be dried. Further, a barometer 16, a thermostat 17 and a timer 18 are mounted on the top side of the housing 10. The barometer 16 can indicate the value of the air pressure in the drying chamber 12. The timer 18 is adapted for setting the operation time of the tumbler 15. The thermostat 17 is adapted for controlling the setting of the heating temperature of the heater 13.

The intake pipeline 20 extends from the outside of the housing 10 to the drying chamber 12, having installed therein an intake lint screen 21 and an intake control valve 22. The intake control valve 22 can control open/close of the intake pipeline 20. Further, an intake fan 23 is mounted to the entrance of the intake pipeline 20 and adapted for drawing outside air into the inside of the intake pipeline 20.

The exhaust pipeline 30 extends from the drying chamber 12 to the space outside the housing 10, having installed therein an exhaust lint screen 31 and an exhaust control valve 32. The exhaust control valve 32 can control open/close of the exhaust pipeline 20. Further, an exhaust fan 33 is mounted to the rear end of the exhaust pipeline 30 and adapted for drawing air out of the drying chamber 12.

The air-suction pipeline 40 is disposed in communication between the drying chamber 12 and the space outside the drying chamber 12, having installed therein an air-suction lint screen 41, a pipeline control valve 42 and a pump 43. The air-suction pipeline 40 can be extended directly from the drying chamber 12 to the outside of the housing 10, or connected between the drying chamber 12 and the exhaust pipeline 30 for communication with the space outside the housing 10 through the exhaust pipeline 30 as shown in FIG. 1, the air-suction pipeline 40 is connected with the exhaust pipeline 30 on an outlet side of the exhaust control valve 32.

The tumble dryer of the present invention is to change the drying chamber to a low-pressure or vacuum condition by drawing air out, so that air moisture can be fully drawn away from the drying chamber subject to the physical principle that fluid can be evaporated easily under low pressure. Actually, as shown in FIG. 1, outside air can flow through the intake pipeline 20, the intake lint screen 21 and the intake air control valve 22 into the drying chamber 12, and then the heater 13 is operated to heat the washing and/or object in the tumbler 15, causing the water content in washing to be vaporized into air vapor that is then carried away from the drying chamber 12 to the atmosphere through the exhaust lint screen 31 and the exhaust control valve 32.

Figure 2:
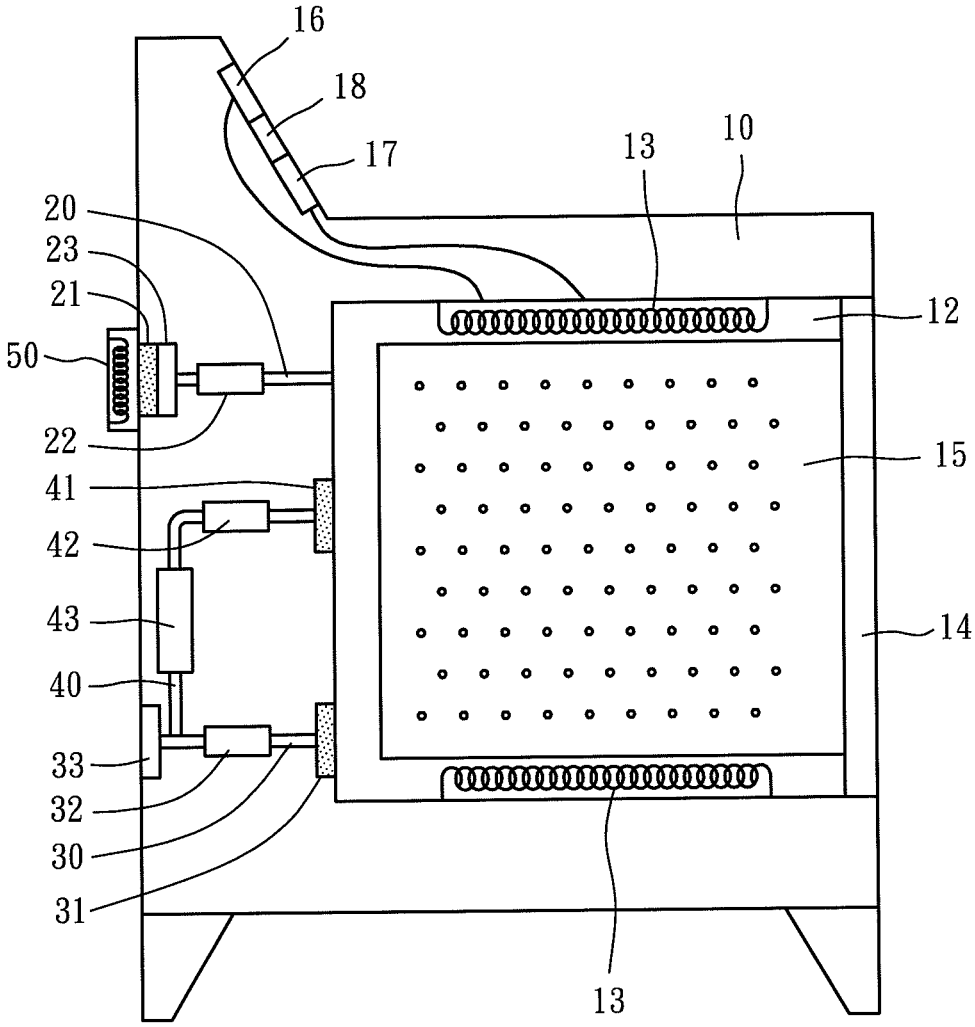
FIG. 2 is a schematic sectional side view of a tumble dryer in accordance with a second embodiment of the present invention.

FIG. 2 shows a tumble dryer in accordance with a second embodiment of the present invention. According to this second embodiment, a pre-heater 50 is mounted on the outside of the housing 10 and adapted for heating intake air so that pre-heated warm air flows through the intake pipeline 20 and the intake lint screen 21 and the intake air control valve 22 into the drying chamber 12 to warm up washing in the tumbler 15, and then the heater 13 is operated to heat the washing and/or object in the tumbler 15, causing the water content in washing to be vaporized into air vapor that is then carried away from the drying chamber 12 to the atmosphere through the exhaust lint screen 31 and the exhaust control valve 32.

When sufficient high-density air vapor is produced in the drying chamber 12, all the control valves 22;32;42 are closed to keep the drying chamber 12 in an enclosed condition, and then open the pipeline control valve 42 and then start the pump 43 to draw air vapor out of the drying chamber 12 through the exhaust lint screen 41 and the pipeline control valve 42 to the atmosphere. During operation, air and moisture can be continuously drawn away from the drying chamber 12. Alternatively, the pipeline control valve 42 can be closed and the pump 43 can be turned off to keep the drying chamber 12 in a low pressure condition, and then uses the heater 13 to heat the washing and/or object in the drying chamber 12 continuously for causing the water content in washing to be vaporized into air vapor. When the reading of the barometer 16 reaches a predetermined value, open the pipeline control valve 42 and then start the pump 43 to draw air vapor out of the drying chamber 12 through the exhaust lint screen 41 and the pipeline control valve 42 to the atmosphere. Subject to the reading of the barometer 16 and counting of the timer 17 to measure the rising speed of air pressure, the dry rate of washing is evaluated.

Further, after drawing of air vapor out of the enclosed drying chamber in the primary state, the rising speed of air pressure in the drying chamber may be excessively high, the dry rate of washing may not reach the desired level, and washing in the tumbler may still contain a certain amount of moisture. At this time, in order to accelerate the heating process of heating the water content in washing into air vapor, the intake control valve 22 can be opened for letting hot air generated by the pre-heater 50 flow through the intake lint screen 21 and the intake control valve 22 into the tumbler 15 in the drying chamber 12 to mix with the air in the tumbler 15 during rotation of the tumbler 15 to turn washing over and over. Thus, the water content in washing in the tumbler 15 can be vaporized into air vapor rapidly, and then drawn away from the drying chamber 12 into the atmosphere. Thus washing in the tumbler 15 can be dried quickly.

In conclusion, the invention is to draw air out of the drying chamber 12 continuously or intermittently to keep the drying chamber 12 in a low pressure condition or vacuum condition, facilitating quick dry of washing. Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tumble dryer, comprising:

a housing, said housing comprising an enclosable drying chamber, a heater mounted in said drying chamber, a gate disposed at one side of said drying chamber for access control and a tumbler rotatably mounted in said drying chamber for turning washing over and over;

an intake pipeline extending from the outside of said housing to said drying chamber for guiding outside air into said drying chamber, said intake pipeline comprising an intake control valve controllable to open/close said intake pipeline;

an exhaust pipeline extending from said drying chamber to the outside of said housing for guiding air out of said drying chamber to the atmosphere, said exhaust pipeline comprising an exhaust control valve controllable to open/close said exhaust pipeline and an exhaust fan mounted to a downstream end of the exhaust pipeline at an inner surface of the housing and adapted for drawing air out of the drying chamber; and an air-suction pipeline disposed in communication between said drying chamber and the space outside said drying chamber, said air-suction pipeline comprising a pipeline control valve controllable to open/close said air-suction pipeline and a pump controllable to pump air out of said drying chamber directly to the atmosphere and keep the drying chamber in a low pressure condition, wherein an upstream end of said air-suction pipeline is connected to the drying chamber, and a downstream end of said air-suction pipeline is connected to said exhaust pipeline between said exhaust control valve and said exhaust fan.

2. The tumble dryer as claimed in claim 1, wherein said intake pipeline has an intake lint screen mounted therein.

3. The tumble dryer as claimed in claim 1, wherein said exhaust pipeline has an exhaust lint screen mounted therein.

4. The tumble dryer as claimed in claim 1, wherein said air-suction pipeline has an air-suction lint screen mounted therein.

5. The tumble dryer as claimed in claim 1, wherein said housing has a barometer mounted therein and adapted for indicating the value of the air pressure in said drying chamber.

6. The tumble dryer as claimed in claim 1, wherein said housing has a thermostat mounted therein and adapted for controlling the setting of the heating temperature of said heater.

7. The tumble dryer as claimed in claim 1, wherein said housing has a timer mounted therein and adapted for setting the operating time of said tumbler.

8. The tumble dryer as claimed in claim 1, further comprising a pre-heater for heating air entering said intake pipeline.

9. The tumble dryer as claimed in claim 1, wherein said intake pipeline has an intake fan mounted therein and adapted for drawing outside air into said intake pipeline.

10. The tumble dryer as claimed in claim 1, wherein said air-suction pipeline is connected with said exhaust pipeline on an outlet side of the exhaust control valve.

11. The tumble dryer as claimed in claim 1, wherein said air-suction pipeline is extended directly from said drying chamber to the outside of said housing.

* * * * *